US006554297B2

(12) United States Patent
Phillips et al.

(10) Patent No.: US 6,554,297 B2
(45) Date of Patent: Apr. 29, 2003

(54) DIVE RESISTANT BUCKLE

(75) Inventors: Frank Phillips, Richmond, VT (US); David Perry, Essex Junction, VT (US); Graham Scott Taylor, Morrisville, VT (US)

(73) Assignee: The Burton Corporation, Burlington, VT (US)

( * ) Notice: Subject to any disclaimer, the term of this patent is extended or adjusted under 35 U.S.C. 154(b) by 33 days.

(21) Appl. No.: 09/753,748

(22) Filed: Jan. 3, 2001

(65) Prior Publication Data

US 2002/0084604 A1 Jul. 4, 2002

(51) Int. Cl.[7] ..... A63C 9/04; A43B 5/04; A43C 11/14

(52) U.S. Cl. ..... 280/14.22; 280/619; 36/117.1; 24/68 SK; 24/71 SK

(58) Field of Search ..... 280/619, 14.21, 280/14.22, 623; 24/68 SK, 69 SK, 70 SK, 71 SK; 36/117.1

(56) References Cited

U.S. PATENT DOCUMENTS

| | | | |
|---|---|---|---|
| 357,287 | A | 2/1887 | Nolte |
| 376,055 | A | 1/1888 | Hopkins et al. |
| 478,120 | A | 7/1892 | Mead |
| 3,258,820 | A | 7/1966 | Steinberg |
| 3,292,222 | A | 12/1966 | Steinberg |
| 3,662,435 | A | 5/1972 | Allsop |
| 4,112,557 | A | 9/1978 | Salomon |
| 4,193,171 | A | 3/1980 | Lichowsky |
| 4,310,951 | A | 1/1982 | Riedel |
| 4,326,320 | A | 4/1982 | Riedel |
| 4,387,517 | A | 6/1983 | Annovi |
| 4,395,801 | A | 8/1983 | Gabrielli |
| 4,453,290 | A | 6/1984 | Riedel |
| 4,547,980 | A | 10/1985 | Olivieri |
| 4,649,657 | A | 3/1987 | Iwama |
| 4,670,946 | A | 6/1987 | Olivieri |
| 4,683,620 | A | 8/1987 | Valsecchi et al. |
| 4,761,898 | A | 8/1988 | Courvoisier et al. |
| 4,796,337 | A | 1/1989 | Marxer |
| 5,172,454 | A | 12/1992 | Martignago |
| 5,416,952 | A | 5/1995 | Dodge |
| 5,426,826 | A | 6/1995 | Takimoto |
| 5,495,683 | A | 3/1996 | Miotto et al. |
| 5,526,555 | A | 6/1996 | Battistella et al. |
| 5,575,045 | A | 11/1996 | Chu |
| RE35,418 | E | 1/1997 | Martignago |
| 5,606,779 | A | 3/1997 | Lu |
| 5,701,639 | A | 12/1997 | Chen |
| 5,727,797 | A | 3/1998 | Bowles |

(List continued on next page.)

FOREIGN PATENT DOCUMENTS

| | | |
|---|---|---|
| EP | 793 983 A1 | 9/1997 |
| JP | 6-13512 | 2/1994 |
| JP | 8-242907 | 9/1996 |
| JP | 8-299527 | 11/1996 |
| JP | 3050416 | 4/1998 |
| JP | 10-155503 | 6/1998 |

OTHER PUBLICATIONS

European Search Report.
Japanese Utility Model Technical Assessment.

*Primary Examiner*—Brian L. Johnson
*Assistant Examiner*—Jeffrey J Restifo
(74) *Attorney, Agent, or Firm*—Wolf, Greenfield & Sacks, P.C.

(57) ABSTRACT

A buckle for fastening a strap having a mounting location especially arranged relative to a force resolving location of the buckle to control dive of the buckle in a particular direction when the strap is cranked down. A mounting location includes a pair of flanges extending sideways from the buckle housing and away from a floor of the housing.

54 Claims, 4 Drawing Sheets

U.S. PATENT DOCUMENTS 5,745,959 A 5/1998 Dodge
5,745,963 A 5/1998 Graziano
5,758,895 A 6/1998 Bumgarner
5,769,446 A 6/1998 Borsoi
5,779,259 A 7/1998 Lin
5,845,371 A 12/1998 Chen
5,852,852 A 12/1998 Rigal
5,887,318 A 3/1999 Nicoletti
5,909,850 A 6/1999 Cavasin et al.
5,909,886 A 6/1999 Tugutaka et al.
6,009,638 A 1/2000 Maravetz et al.
6,163,941 A * 12/2000 Lai ..... 24/580
6,175,994 B1 * 1/2001 Nicoletti ..... 24/68 SK
6,250,651 B1 * 6/2001 Reuss et al. ..... 280/14.21

* cited by examiner

DIVE RESISTANT BUCKLE

FIELD OF THE INVENTION

The invention relates to a dive resistant buckle.

BACKGROUND OF THE INVENTION

Binding devices are employed to secure a rider to boards and other devices configured for gliding, such as snowboards, snow skis, water skis, wake boards, surf boards and the like. For purposes of this patent, "gliding implement" will refer generally to any of the foregoing boards as well as to other devices which allow a rider to traverse a surface.

Certain types of bindings, known as strap or tray bindings, employ elongated straps to mount a rider's foot or boot to a gliding implement. A strap type snowboard binding, for example, includes a baseplate adapted to receive a rider's boot and one or more straps extending across a boot receiving area for securing the boot to the binding. Typical are a toe strap and an ankle strap, each of which is formed of a toothed section, commonly referred to as a ratchet strap, and a boot engagement section that includes a buckle that engages with, and prevents inadvertent withdrawal of, the ratchet strap as the strap sections are tightened together to secure the boot in the binding.

The strap sections 20 and 22, of the prior art binding illustrated in FIG. 1, may be separated from each other to provide an opening for the rider to place his or her boot into the binding. An end of the ratchet strap 20 may be fed by hand into the buckle 24 and then may be incrementally tightened by actuating the drive lever 28. Tightening of the strap sections increases the forces acting at the point of contact between the buckle pawl 26 and the engaged tooth on the ratchet strap which are resolved on the buckle along the pin P that pivotally mounts the pawl to the buckle housing. The buckle is mounted through the housing floor to the boot engagement strap. Because the mounting hole 30 is positioned below the location of the resolved forces acting at point P on the buckle, a moment is created in the direction of the boot engagement member. The moment causes the buckle to dive or twist downward, potentially digging into the rider's boot which may be painful particularly when the straps have been cranked down tightly.

It is an object of the present invention to provide a buckle for securing a strap, or strap sections, that is resistant to diving when the components are fastened together.

SUMMARY OF THE INVENTION

In one embodiment of the invention there is provided a dive resistant buckle for fastening a strap. The buckle includes a housing having an entrance, an exit and a floor along which the strap travels in a tightening direction from the entrance towards the exit and in a loosening direction from the exit towards the entrance. A strap engagement member is supported by the housing which prevents withdrawal of the strap in the loosening direction. When the strap sections are tightened, the forces acting on the strap engagement member and the ratchet strap are rectified on the buckle at a force resolving location. The buckle housing includes a mounting location for attaching the buckle to a surface, such as a boot or foot engagement strap when the buckle is incorporated in a boot or foot binding, that is spaced away from the floor of the buckle in the direction of the resolved location.

In another embodiment of the invention there is provided a dive resistant buckle for fastening a strap including a U-shaped housing having a pair of sidewalls and a floor along which the strap travels in a tightening direction from an entrance portion to an exit portion and in a loosening direction from the exit portion to the entrance portion. A pawl is pivotally mounted to the sidewalls along a first axis and engages the strap to prevent movement in the loosening direction. The U-shaped housing includes a pair of mounting flanges that extend outwardly from the housing sidewalls which have respective locations for attaching the dive resistant buckle to a surface, such as a boot or foot engagement strap when the buckle is incorporated in a boot or foot binding, that are spaced away from the floor of the housing in a direction of the first axis where the pawl is pivotally mounted to the housing.

In another embodiment of the invention there is provided a dive resistant buckle for fastening a strap including a housing having an entrance portion and an exit portion and including a floor along which the strap travels in a tightening direction from the entrance portion towards the exit portion and in a loosening direction from the exit portion towards the entrance portion. A strap engagement member is supported by the housing which prevents withdrawal of the strap from the buckle in the loosening direction. A mounting location for attaching the housing to a surface, such as a boot or foot engagement strap when the buckle is incorporated in a boot or foot binding, is selected to reduce or eliminate a moment acting on the buckle in the direction of the surface as the strap is tightened by the strap engagement member.

In another embodiment of the invention, there is provided a dive resistant buckle for fastening a strap. The buckle includes a housing for slidably receiving the strap. The buckle includes means for engaging and preventing movement of the strap in a loosening direction from an exit portion of the housing towards an entrance portion while allowing movement of the strap in a tightening direction from the entrance portion towards the exit portion. Means are provided for mounting the buckle to a surface, such as a boot or foot engagement strap when the buckle is incorporated in a boot or foot binding, to reduce or eliminate diving of the entrance portion of the buckle towards the surface as the strap is tightened by the engaging and preventing means.

In a still further embodiment of the invention, there is provided a binding including a dive resistant buckle. The binding includes a base having a boot or foot receiving area. At least one strap is connected to the base and is extendable across the boot receiving area. The at least one strap includes a first section and a second section that are separable to receive and release the boot or foot. The first section includes a toothed surface and the second section includes a buckle having an entrance end, an exit end, a floor along which the first section may travel, and a pawl for engaging the toothed surface. The buckle is mounted to the boot or foot engagement strap through at least one attachment location that is spaced away from the floor of the buckle in a direction of the pawl.

BRIEF DESCRIPTION OF THE DRAWINGS

The invention will be appreciated more fully with reference to the following detailed description of illustrative embodiments thereof, when taken in conjunction with the accompanying drawings, wherein like reference characters denote like features, in which.

DETAILED DESCRIPTION

Figure 1:
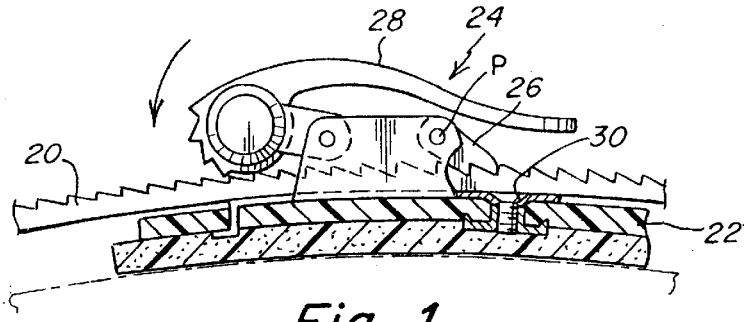
Fig. 1 PRIOR ART
FIG. 1 is an illustration of a prior art buckle.
Figure 2:
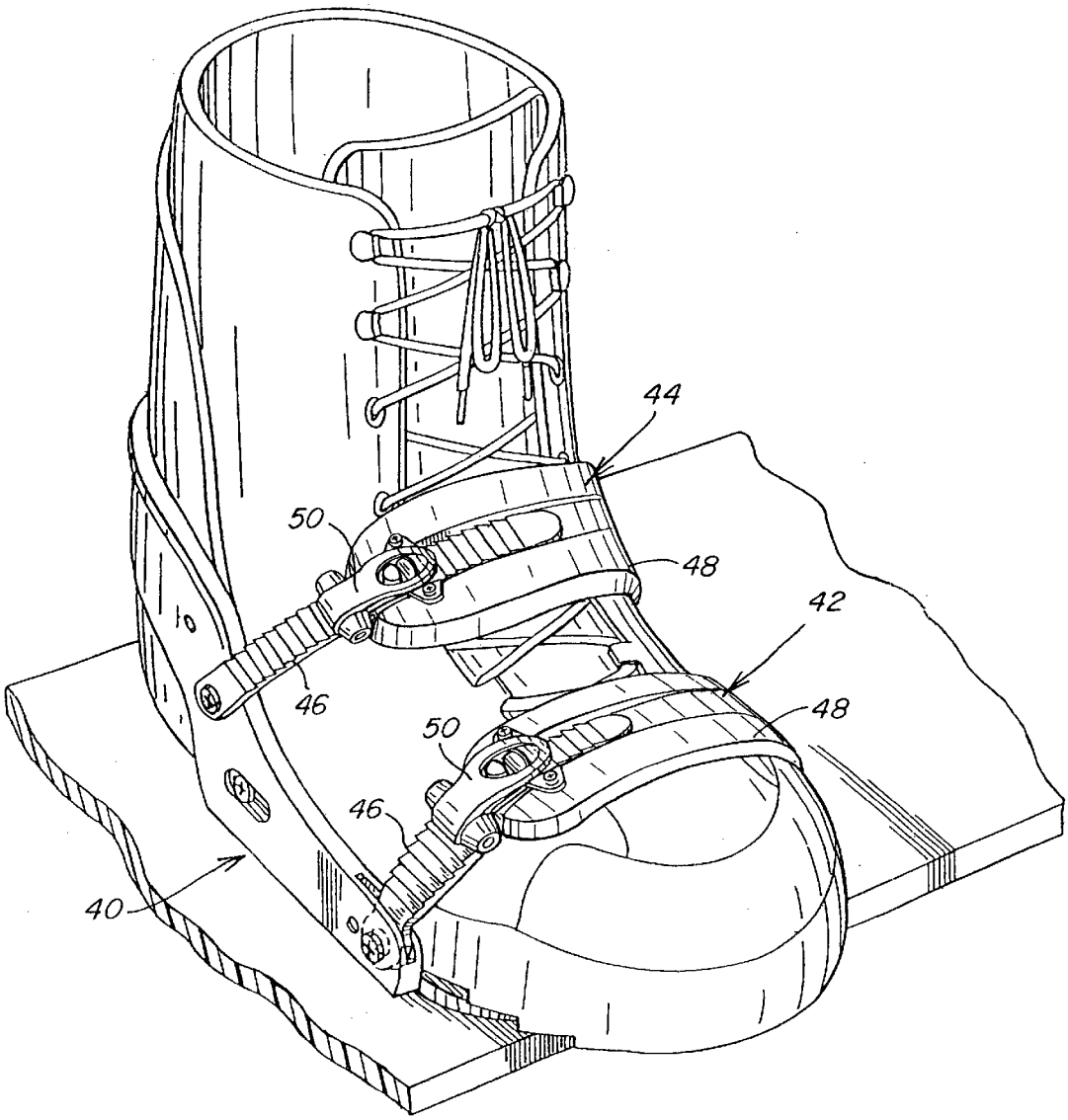
FIG. 2 is a perspective view of a strap type snowboard binding including ankle and toe straps configured with an embodiment of the inventive buckle.
Figure 3:
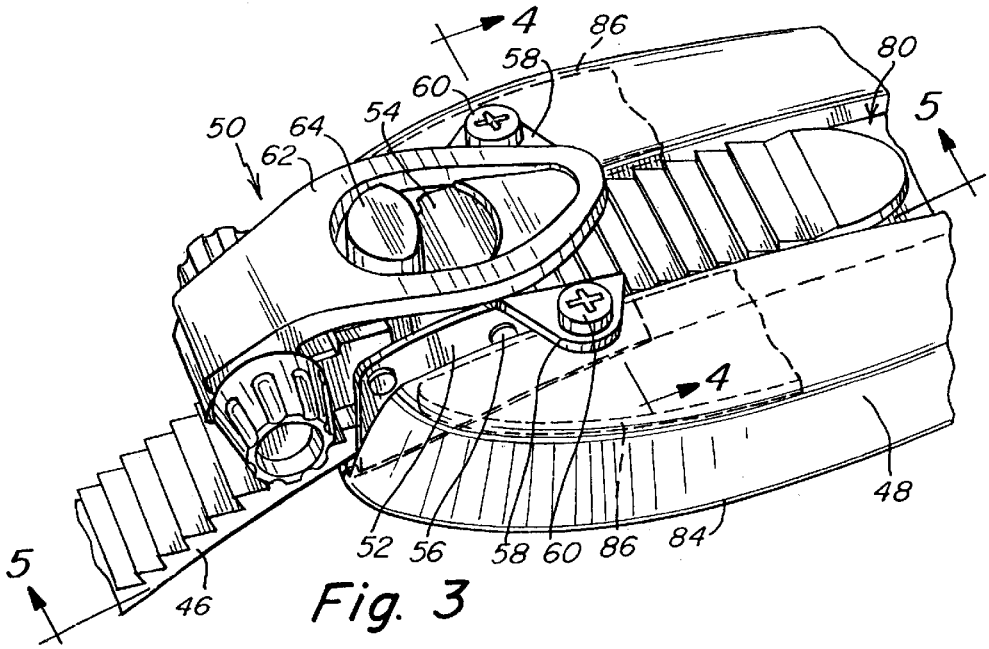
FIG. 3 is a fragmented view of a buckle arranged to mitigate diving mounted to a strap section with a ratchet strap engaged to the buckle.
Figure 4:
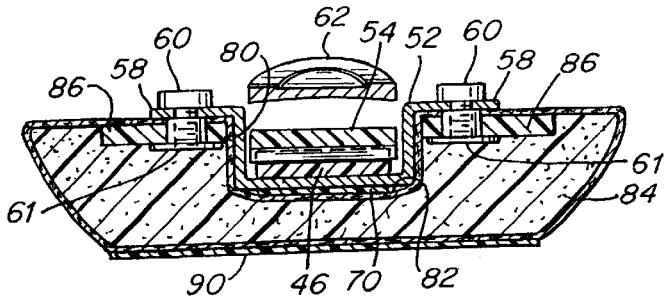
FIG. 4 is a sectional view along line 4—4 of FIG. 3.
Figure 5:
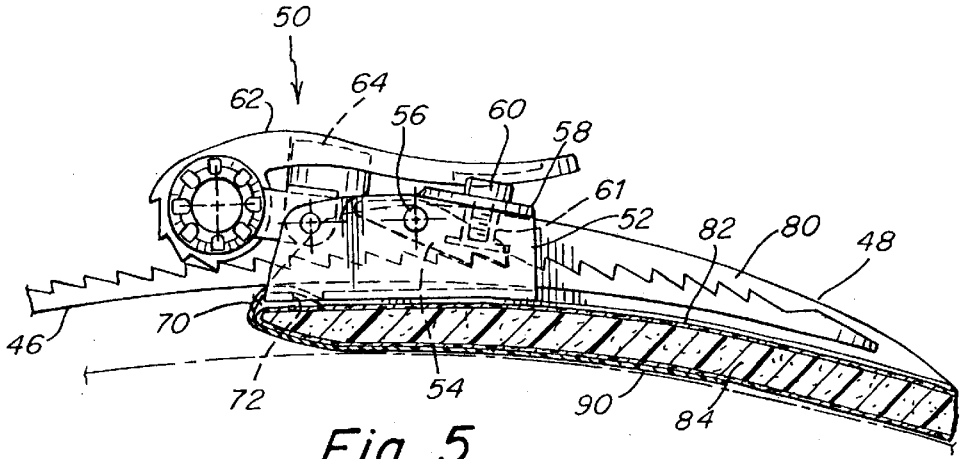
FIG. 5 is a sectional view along line 5—5 of FIG. 3.
Figure 6:
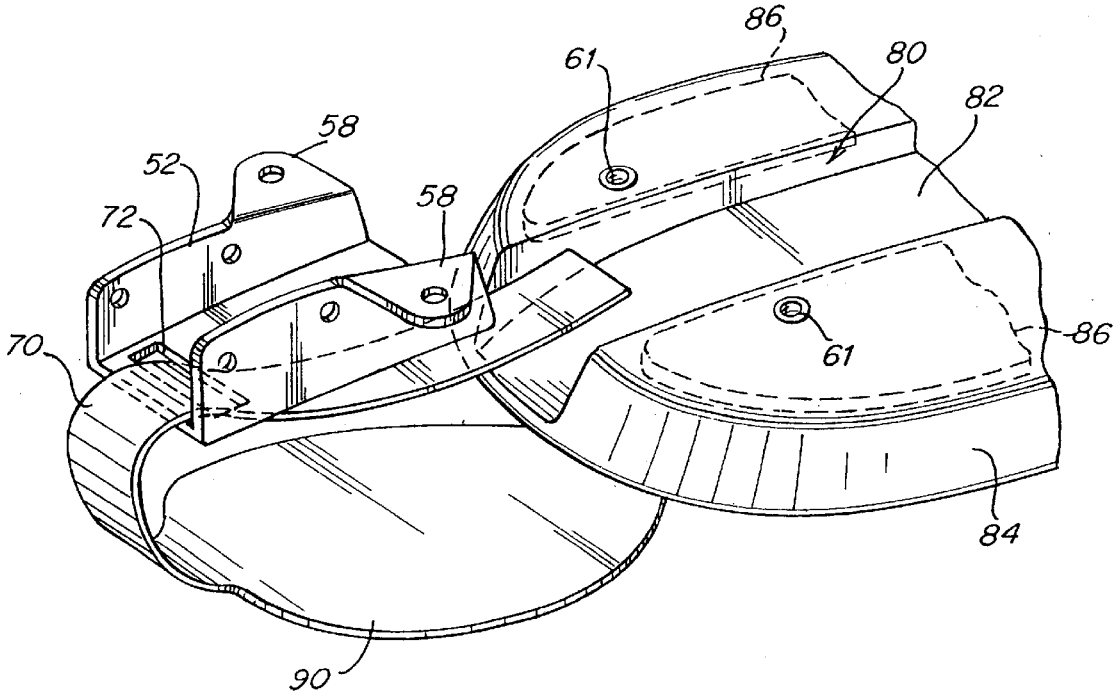
FIG. 6 is an exploded view showing the looping of the plastic strip from beneath the pad, through the slot in the buckle housing, and underneath the floor of the buckle.

The invention is directed to an arrangement for controlling the direction and/or magnitude of a moment operating on a buckle when a strap or other engagement member is tightened to the buckle. The inventive buckle has particular application to a binding having one or more engagement members, such as a strap, for securing an object, such as a boot or foot, to a gliding implement, and to a sport shoe or a boot including one or more engagement members for securing footwear components to improve performance properties such as heel hold down, for example, when the engagement member extends across the tongue or vamp of the sport shoe or boot. In certain embodiments, the buckle is constructed and mounted to a surface, such as a boot or foot engagement strap, so that the buckle does not dig into the rider's boot or foot when the strap is fastened to the buckle, while in other embodiments buckle dive may occur but to a lesser extent as compared to where the buckle has been mounted through a buckle housing floor to the underlying strap.

For ease of understanding, and without limiting the scope of the invention, the inventive buckle to which this patent is addressed is disclosed below particularly in connection with a snowboard binding that is used to secure a rider's boot to a snowboard. It should be appreciated, however, that the inventive buckle construction may be incorporated in a foot or boot binding device that may be mounted to substrates that are not designed specifically for gliding or other sports applications, in a binding device that is employed to restrain objects other than a foot or boot, as well as in non-binding applications including, but not limited to, footwear including one or more straps that are tightenable by a buckle. For the purposes of this patent, "dive resistant buckle" means a buckle for tightening a strap having a buckle bottom that seats against a surface and that is arranged so that the buckle does not pivot towards the surface when the strap is cranked down; that is, the buckle may see no moment or the direction of the moment is away from the surface. "Dive resistant buckle" also means a buckle that is subject to a torquing force, when the strap is secured, in the direction of the surface on which the buckle bottom is seated but where the diving effect is diminished as compared to when the buckle is bottom mounted to the surface.

The embodiment illustrated in FIGS. 2–6 is a snowboard binding 40 arranged with a toe strap 42 and an ankle strap 44 for securing a rider's boot to a snowboard. Each strap includes a ratchet section 46 and a boot engagement section 48 that are separable to allow placement of the boot in the binding and then are securable together to restrain the boot on the snowboard. The ratchet section may be an elongated plastic strip having teeth or other serrations formed along a top surface. The boot engagement section includes a buckle 50 which may have a U-shaped housing 52, as illustrated, provided with an entrance end, an exit end, and a floor along which the ratchet section travels in a tightening direction from the entrance end to the exit end and in a loosening direction from the exit end to the entrance end. The buckle includes a pawl 54 for engaging the toothed surface of the ratchet strap, preventing the ratchet strap from escaping back out of the entrance end of the buckle. A rod or pin 56 pivotally mounts the pawl to the buckle with ends of the pin being seated in apertures in the sidewalls of the buckle housing. A spring or other biasing member, such as a torsion spring, may be provided to urge the pawl tip in contact with the toothed surface. As the ratchet strap is fed through the buckle, the pawl pivots in a reciprocating manner so that it intermittently engages and disengages with the ratchet teeth.

The buckle is attached to the boot engagement section through one or more mounting locations 58 such as the flanges extending outwardly from the sidewalls of the housing. As illustrated, the flanges include holes for receiving fasteners 60 such as screws that are securable to the boot engagement section. Internally threaded inserts 61, such as a T-nut, may be anchored in the boot engagement section to receive the tightening hardware. Other arrangements for fastening the flange to the boot engagement section are contemplated as should be apparent to one of skill in the art. For example, the flange could be provided with a barb or other gripping member that fastens to the boot engagement section. Or the flange could provide a surface for bonding the two components together. While a pair of laterally extending mounting locations are illustrated, the number of mounting locations is not a limitation of the invention and one, three or more mounting locations may be employed.

A mounting location for the buckle is selected to mitigate or eliminate the tendency of the buckle to dive into the boot engagement section in response to the cranking down of the strap sections. The forces acting on the pawl and an engaged tooth are resolved on the buckle housing through the pin 56. A substantially equal and opposite force is applied at the mounting location of the buckle to the boot engagement section. By especially constructing and arranging the mounting location of the buckle relative to the force resolving location, the magnitude and direction of the moment arm seen on the buckle may be controlled. Arranging the mounting location closer to the force resolving location will reduce the size of the moment arm acting on the buckle. The direction of the moment will be dictated by the relative positioning of the mounting location and the force resolving location. Where the mounting location is below the force resolving location, the buckle will be subject to a moment in the direction of the rider's boot. On the other hand, where the mounting location is positioned beyond the force resolving location, then the torque will be in a direction away from the boot engagement section. Substantially aligning the force resolving location and the buckle mounting location should eliminate any appreciable moment on the buckle in either direction.

So, where the mounting location is positioned between the floor of the housing and the pivot axis of the pawl, the buckle may still be subject to diving towards the rider's boot but the magnitude of the resulting moment should be less than if the buckle had been mounted through the floor of the housing to the boot engagement section. No appreciable moment arm should be generated when the mounting location is substantially aligned with the pivot axis. A moment may be created in a direction opposite of the boot engagement section by arranging the buckle mounting location above the pawl pivot axis.

In the illustrated embodiment, a pair of mounting flanges extend substantially perpendicular to the sidewalls of the housing and are substantially aligned with the pivot axis of the pawl so that little or no moment should be created as the strap sections are tightened. The flanges may be formed by bending a section of the sidewall, such as where the buckle housing is formed from a metal blank, by joining a separate flange section to the housing, or by integrally forming the flange sections during fabrication of the housing such as in molding a plastic buckle housing. Other materials and techniques for forming the buckle housing and the flanges will be appreciated by the practitioner. The flanges need not form right angles with the sidewalls and could be angled downwardly or upwardly. Other mounting arrangements for the buckle are contemplated, and the invention is not limited only to the use of mounting flanges. For example, and without limitation, one or more openings could be formed in the sidewalls of the buckle housing which receive an anchor, such as a fastening loop, that is secured to the boot engagement section.

The buckle may include a lever 62 to help drive the toothed ratchet section through the pawl. A release tab 64 for disengaging the pawl from the ratchet section to loosen the strap and/or to allow separation of the strap sections also may be provided. As shown, the pawl is pivotally mounted along a first axis to the housing, the release tab is pivotally mounted to the buckle along a second axis that is spaced from the first axis, while the lever is pivotally mounted about a third axis that is spaced from the first and second axes. A ratchet buckle that is particularly suited for implementation in the present invention, after the mounting location has been modified to make the buckle dive resistant, is a Slap Ratchet® buckle provided in various Burton Snowboards binding models and which is described in U.S. Pat. No. 5,745,959, which is assigned to Burton Snowboards, the owner of the present application. Also suitable after being made dive resistant is a ratchet buckle having a pawl and release tab that pivot about a first axis and a drive lever that pivots about a second axis that is spaced from the first axis which is disclosed in U.S. Pat. No. 5,416,952, also assigned to Burton Snowboards. Other buckle configurations and fastening arrangements for releasably joining two binding strap sections also are contemplated as would be apparent to one of skill in the art.

The entrance end of the buckle may be secured to the boot engagement strap such as by the illustrated arrangement of a retaining strip 70 that passes through a slot 72 in the floor of the buckle housing. The strip may be formed of plastic, fabric or other material, and may run from the bottom surface of the boot engagement section, through the slot and then beneath the floor of the buckle housing where it is fixed to the top surface of the boot engagement section. Other arrangements for attaching the entrance end of the buckle to the boot engagement section also may be employed, including a rivet or other fastener secured through an opening in the housing floor to the underlying strap section. Alternatively, a tongue may depend from the entrance end of the buckle which is embedded in the body of the strap section. In addition to, or as an alternative to the arrangements just mentioned, the surface of the strap section mounting the front end of the buckle may be formed with a recess, one or more projections, or other structure for maintaining the entrance end of the buckle in a desired position on the strap. Any of the foregoing may be employed to prevent the front end of the buckle from spinning relative to the mounting location. Where two mounting locations are employed, each of which extends outwardly from the sidewalls of the housing such as in the embodiment illustrated, there may be less of a concern for sideways twisting of the entrance end of the buckle. However, the loop and slot arrangement and the other configurations described and suggested above may be employed to keep the entrance end of the buckle flush with the surface of the boot engagement section. Otherwise, a space may form between the front of the housing and the underlying strap section where the tip of the ratchet strap section may catch when the rider attempts to join the strap sections together.

Figure 7:
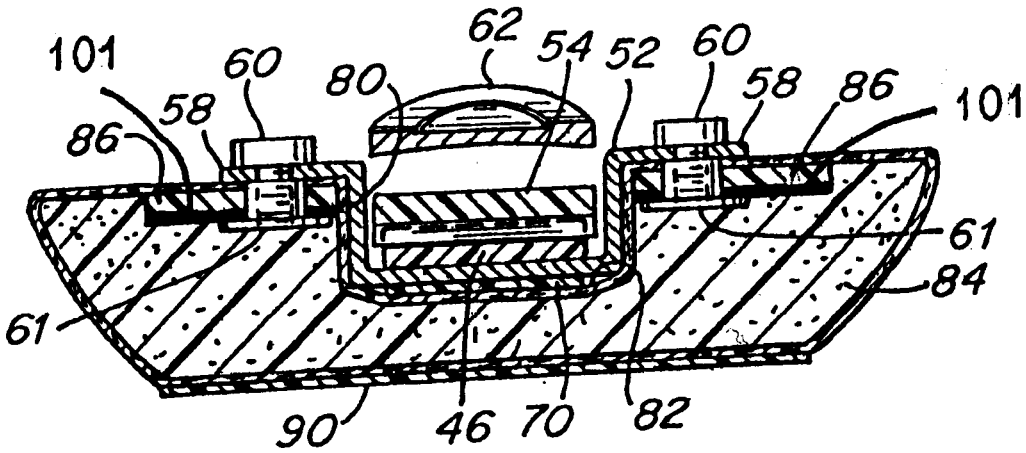
FIG. 7 is a sectional view, similar to FIG. 4, of an inventive buckle in accordance with another illustrative embodiment of the invention.

A channel or recess 80 may be provided in the strap section to accommodate the buckle. The floor of the buckle housing may seat on a base 82 of the channel with the mounting flanges resting on the shoulders or wall portions of the strap defining, or adjacent, the channel. The strap section may include a cushioning layer 84 and a stiffer force transmitting layer 86 to which the mounting flanges are secured. The force transmitting layer may consist of a rigid plastic sheet that includes two elongated bands that are separated by a pressure relief opening. The bands may converge at one end but remain spaced apart at the other end, forming an access opening for the buckle housing to seat onto the underlying cushioning material. A spacer layer 101 may be sandwiched between the force transmitting layer and the cushioning layer, as shown in FIG. 7, to provide the depth necessary for the channel to receive the buckle housing. A pair of walls may depend from the force transmitting layer which abut, or lie closely adjacent to, the sidewalls of the buckle housing. A pair of internally threaded inserts 61 may be mounted in the force transmitting bands which are engageable with screws to fasten the mounting flanges to the strap section. Rather than configure the buckle mounting portion of the strap with a recess, the surface of the boot engagement section may be built up to provide a pedestal or other mount for the buckle. That is, for a buckle arranged with sideways extending flanges as described above, a pair of raised mounts could project from the surface of the strap section and be arranged with appropriate hardware, or otherwise be configured, to engage with fasteners for securing the mounting flanges. In the latter embodiment, the bottom of the buckle housing may seat on the top surface of the strap and the ends of the force transmitting bands need not be spaced apart as the strap does not require a channel.

Although the illustrated binding has two straps each of which is arranged with a dive resistant buckle, the invention is not limited to a dual strap arrangement. Rather, the invention encompasses a binding having any number of straps that include a buckle constructed and arranged to prevent the entrance end of the buckle from digging into the rider's boot when the straps are secured. Thus, a binding with only a toe strap or an ankle strap, or a binding with a toe strap, an ankle strap and a shin strap are contemplated as are other binding constructions that employ different strap arrangements not expressly mentioned here. Further, the invention contemplates a binding having two or more straps where one or more but not all of the straps are arranged with a buckle that resists diving. That is, some of the straps may include a buckle that is not specially configured to avoid torquing into the boot engagement section as the straps are cranked down but that arrangement is still within the scope of this invention so long as at least one strap is configured with a buckle that is dive resistant. Alternatively, the binding may include engagement members that do not rely on buckles, such as step-in type binding components, in addition to one or more straps that include a buckle arranged to prevent or limit diving of the buckle when the strap is under tension.

Although separate strap sections have been described, the strap may be a single continuous member that extends from one side of the baseplate to the other where it is fastened to a buckle supported by the binding. Where separable strap sections are employed, the boot engagement strap is typically longer than the ratchet strap and may include a body portion that is conformable to the portion of the boot that it contacts as the straps are tightened together. The contacting portion of the boot engagement section may be padded or otherwise specially configured for relieving pressure on sensitive areas of the foot. For example, where the strap is an ankle strap, a central portion of the body may have a reduced thickness, be formed of a compressible material, or may include one or more slotted sections to reduce rider discomfort. The strap, or specific strap sections, may be bendable into a substantially U-shape that tracks the contours of the rider's boot about which it is tightened. Upon release of the strap or disengagement of the strap sections, the strap may spring partially or fully open to provide a path for removal of the boot from the binding. The strap sections may be stiffer at the mounting end and more flexible towards the opposite end to encourage conformability to the boot surface as the strap is tightened down. The ratchet strap may include a rounded narrower tip to facilitate introduction into the buckle. Although the ratchet strap may have teeth as illustrated, an arrangement where the upper surface is smooth as well as an arrangement where the teeth are arranged on one or both sides, or on the bottom of the strap, also are contemplated as would be apparent to one of skill in the art.

The length of a strap or of individual strap sections may be adjustable; for example, a strap section may consist of a first member that is telescopically mounted to a second member and may include hardware or other fastening mechanism to fix the two members at a desired overall strap section length. Adjustable length straps that are not configured telescopically also are within the inventive arrangement as are unvarying, single length straps. A low friction material, such as a plastic sheet 90, may be placed on the bottom of the strap section beneath the buckle to resist frictional forces as the strap is tightened down about the boot. The strip which runs through the slot, or other engagement structure, in the buckle may be an extension of this friction resistant material. To assemble the strap components together, a fabric covering may envelope the force transmitting and cushioning layers, and any spacer layer, with a friction resistant pad, if desired, attached to the fabric along the bottom of the strap. Suitable strap forming materials include molded, extruded or cast plastics, natural or synthetic fabrics, metal strips, and a combination of any of the above materials.

The snowboard binding illustrated includes a baseplate having a floor, sidewalls and a heel hoop. Plateless binding bases also are contemplated, which eliminate the floor so that a rider's boot seats directly on the snowboard surface. Also contemplated is an arrangement where the straps are mounted directly to the snowboard, such as in slots provided in the snowboard surface. The binding may include a highback that coacts with a heel hoop for providing heelside support and heel edge control. A forward lean adjuster may also be provided to set the highback at a preselected forward lean angle relative to the board. A hold-down disc may be used to secure the baseplate to the snowboard in any one of numerous stance angles. Various other features may be implemented to enhance riding performance. Although the binding described here is constructed to secure a snowboard rider's boot, a binding incorporating a strap with the inventive dive resistant buckle may be configured to restrain other objects as well, with the identity of the element contained by the binding not being an essential component of the invention.

The dive resistant buckle may be employed in a sports shoe or boot, particularly a hybrid boot or soft boot compatible with a step-in snowboard binding. Considerable lifting forces are generated at the heel of a snowboarder during riding. To maximize rider control, it is desirable to prevent the rider's foot, particularly the heel, from lifting off the bottom of the boot. In the "tray" type binding discussed earlier, the ankle strap can be tightened down over the boot to prevent heel lift. However, with a strapless soft boot step-in binding, there is no boot engagement strap on the binding for limiting heel lift. Although the laces of the snowboard boot are available to resist lifting forces, the laces alone are often not up to the task. Consequently, many soft boots adapted for use with a step-in binding employ an ankle strap in addition to a lacing system. The ankle strap, similar to the ankle strap described above in connection with a snowboard binding, includes a ratchet strap and a boot engagement strap provided with a ratchet buckle. Each of the two strap components has a fixed end that is attached to a side of the boot, with the respective free ends being joined together. The location of the buckle mount may be selected to minimize or eliminate buckle dive in the same manner as described earlier in connection with a binding strap. That is, the mounting structure, such as a pair of sideways extending flanges, may be arranged closer to the force resolving location on the buckle, which again may be the pivot axis for the buckle pawl. The mounting location may be spaced from the floor of the buckle housing so that it extends between the floor and the pawl pivot axis or may be positioned above the pawl pivot axis. In all of these arrangements, the result will be a lesser moment acting on the buckle in the direction of the boot or no moment in the direction of the boot, as compared to when the buckle is fastened through the floor of the housing to the ankle strap.

Having described several embodiments of the invention in detail, various modifications and improvements will readily occur to those skilled in the art. Such modifications and improvements are intended to be within the spirit and scope of the invention. Accordingly, the foregoing description is by way of example only and is not intended as limiting. The invention is limited only as defined by the following claims and their equivalents.

What is claimed is:

1. A dive resistant buckle for fastening a strap, comprising:

a housing having an entrance portion and an exit portion and including a floor along which the strap travels in a tightening direction from said entrance portion towards said exit portion and in a loosening direction from said exit portion towards said entrance portion;

a strap engagement member supported by said housing, said strap engagement member preventing withdrawal of the strap from said housing in said loosening direction, said housing having a force resolving location at which forces from said strap engagement member preventing withdrawal of the strap act on said housing; and a mounting location supported by said housing for attaching said housing to a surface, said mounting location being spaced away from said floor in a direction toward said farce resolving location.

2. The buckle recited in claim 1 wherein said mounting location is positioned between said floor and said force resolving location.

3. The buckle recited in claim 1 wherein said mounting location is positioned substantially aligned with said force resolving location.

4. The buckle recited in claim 1 wherein said force resolving location is positioned between said floor and said mounting location.

5. The buckle recited in claim 1 wherein said strap engagement member is pivotally mounted to said housing.

6. The buckle recited in claim 5 further including a spring for biasing said strap engagement member into engagement with the strap.

7. The buckle recited in claim 5 wherein an axis along which said strap engagement member is pivotally mounted to said housing is said force resolving location.

8. The buckle recited in claim 1 wherein said strap engagement member is a pawl.

9. The buckle recited in claim 1 wherein said buckle includes a release actuator for disengaging said strap engagement member from the strap.

10. The buckle recited in claim 1 further including a lever for driving the strap through said housing.

11. The buckle recited in claim 1 wherein said mounting location includes a pair of mounting locations.

12. The buckle recited in claim 11 wherein said pair of mounting locations includes a pair of flanges.

13. The buckle recited in claim 12 wherein each of said pair of flanges includes an opening for receiving a fastener to attach said buckle to the surface.

14. The buckle recited in claim 1 mounted onto a strap that is conformable to an object against which it is tightened, said strap including a recess for receiving said housing.

15. The buckle recited in claim 14 wherein said recess includes a base on which is seated a bottom of said housing, said mounting location including a pair of flanges extending outwardly from said housing and seated on a surface of said strap defining said recess.

16. The buckle recited in claim 14 wherein said strap engagement member is mounted to said housing along an axis, said axis being spaced away from said recess base.

17. The buckle recited in claim 16 wherein said axis is substantially aligned with said mounting location.

18. The buckle recited in claim 16 wherein said axis is positioned between said mounting location and said recess base.

19. The buckle recited in claim 1 mounted onto a strap that is conformable to an object against which it is tightened, said strap including a raised mount upon which is seated said mounting location of said housing.

20. The buckle recited in claim 1 mounted onto a strap, said strap including a force transmitting layer, said force transmitting layer including a pair of bands spaced apart to form a recess for receiving said buckle housing.

21. The buckle mounted onto a strap recited in claim 20 wherein a wall depends from each of said pair of bands that define respective sides of said recess.

22. The buckle mounted onto a strap recited in claim 21 further including a cushioning layer.

23. The buckle mounted onto a strap recited in claim 22 wherein a bottom of said buckle housing seats on said cushioning layer.

24. The buckle mounted onto a strap recited in claim 22 further including a spacer layer between said force transmitting layer and said cushioning layer.

25. The buckle recited in claim 1 included in a binding.

26. The buckle and binding recited in claim 25, wherein said binding includes a base and one or more straps attached to the base, said buckle being mounted to at least one of said straps.

27. The buckle recited in claim 1 in combination with a shoe or boot.

28. The buckle and shoe or boot recited in claim 27, wherein said shoe or boot includes at least one strap and said buckle is mounted to said at least one strap.

29. The buckle recited in claim 1 wherein the strap engagement member is movable between an engagement position and a disengagement position.

30. The buckle recited in claim 1 wherein at least a portion of the entrance portion is spaced away from the force resolving location in a direction of the floor.

31. The buckle recited in claim 1 wherein the strap engagement member includes a locking surface for engaging the strap, the locking surface being opposed to the floor of the housing.

32. The buckle recited in claim 1 wherein the floor of the housing extends from the entrance portion to the exit portion.

33. The buckle recited in claim 1 wherein said buckle includes a release actuator for disengaging said strap from said strap engagement member.

34. A dive resistant buckle for fastening a strap, comprising:

a U-shaped housing including a pair of opposed sidewalls and a floor along which the strap travels in a tightening direction from an entrance portion towards an exit portion and in a loosening direction from said exit portion towards said entrance portion;

a pawl pivotally mounted to said pair of opposed side walls along a first axis for engaging the strap and preventing movement of the strap in the loosening direction;

said U-shaped housing including a pair of mounting flanges extending outwardly from said housing sidewalls having respective locations for attaching said dive resistant buckle to a surface, said respective attaching locations being spaced away from said floor in a direction of said first axis.

35. The buckle recited in claim 34 wherein said pair of mounting flanges are substantially aligned with said first axis.

36. The buckle recited in claim 34 wherein said pair of mounting flanges are positioned intermediate said housing floor and said first axis.

37. The buckle recited in claim 34 wherein said pair of mounting flanges are positioned beyond said first axis.

38. The buckle recited in claim 34 wherein said pair of mounting flanges extend substantially perpendicularly from said housing.

39. The buckle recited in claim 34 wherein each of said pair of mounting flanges includes an opening for receiving a fastener for securing said buckle to the surface.

40. The buckle recited in claim 34 further including a lever pivotally mounted to said housing along a second axis for driving the strap through said housing.

41. The buckle recited in claim 40 further including a release actuator pivotally mounted to said housing along a third axis for disengaging said pawl from the strap.

42. The buckle recited in claim 34 further including a release actuator pivotally mounted to said housing along said first axis.

43. A binding including a dive resistant buckle, comprising:

a base having a boot or foot receiving area; and at least one strap connected to said base and extendable across said boot receiving area, said at least one strap including a first section and a second section, said first and second sections being separable to receive and release the boot, said first section including a toothed surface and said second section including a boot or foot engagement strap provided with a buckle having a housing including an entrance end, an exit end, a floor along which said first section may travel, and a pawl for engaging said toothed surface, said buckle including at least one attachment location where said housing is mounted to said boot or foot engagement strap, said at least one attachment location being spaced away from said floor in a direction toward said pawl.

44. The binding recited in claim 43 wherein said base is adapted to receive a snowboard boot.

45. The binding recited in claim 43 wherein said base further includes a highback.

46. The binding recited in claim 43 wherein said boot or foot engagement strap includes a force transmitting layer, said force transmitting layer including a pair of bands spaced apart to form a recess for receiving said buckle housing.

47. The binding recited in claim 46 wherein a wall depends from each of said pair of bands that defines respective sides of said recess.

48. The binding recited in claim 47 further including a cushioning layer.

49. The binding recited in claim 48 wherein a bottom of said buckle housing seats on said cushioning layer.

50. The binding recited in claim 48 further including a spacer layer between said force transmitting layer and said cushioning layer.

51. The binding recited in claim 43 wherein said buckle housing includes a slot and a retaining strip runs through said slot to hold said entrance end flush with said boot or foot engagement strap.

52. The binding recited in claim 51 wherein a bottom of said boot or foot engagement strap includes a friction resistant pad and an extension of said friction resistant pad forms said strip.

53. The binding recited in claim 51 wherein said strip passes beneath said buckle housing.

54. The binding recited in claim 43 wherein the pawl is positioned between the floor and said at least one attachment location.

* * * * *